US008638240B2

(12) United States Patent
Glover et al.

(10) Patent No.: US 8,638,240 B2
(45) Date of Patent: Jan. 28, 2014

(54) AIRPORT TAXIWAY COLLISION ALERTING SYSTEM

(75) Inventors: John Howard Glover, Yarrow Point, WA (US); Kevin J Conner, Kent, WA (US)

(73) Assignee: Honeywell International Inc., Morristown, NJ (US)

( * ) Notice: Subject to any disclaimer, the term of this patent is extended or adjusted under 35 U.S.C. 154(b) by 256 days.

(21) Appl. No.: 13/022,057

(22) Filed: Feb. 7, 2011

(65) Prior Publication Data

US 2012/0200433 A1 Aug. 9, 2012

(51) Int. Cl.
*G08G 5/04* (2006.01)

(52) U.S. Cl.
USPC ..... 340/961; 340/933; 340/972; 701/120; 701/301

(58) Field of Classification Search
USPC ..... 340/933, 961, 972; 701/120, 301
See application file for complete search history.

(56) References Cited

U.S. PATENT DOCUMENTS

| | | | | |
|---|---|---|---|---|
| 5,321,406 | A | 6/1994 | Bishop et al. | |
| 6,216,064 | B1 | 4/2001 | Johnson et al. | |
| 7,006,032 | B2 | 2/2006 | King et al. | |
| 7,109,889 | B2 | 9/2006 | He | |
| 7,117,089 | B2 | 10/2006 | Khatwa et al. | |
| 7,634,353 | B2 | 12/2009 | Meunier et al. | |
| 2007/0067093 | A1 * | 3/2007 | Pepitone | 701/120 |
| 2008/0062011 | A1 * | 3/2008 | Butler et al. | 340/961 |
| 2009/0009357 | A1 * | 1/2009 | Heen et al. | 340/825.49 |
| 2009/0115637 | A1 | 5/2009 | Naimer et al. | |
| 2011/0127366 | A1 | 6/2011 | Becker | |

FOREIGN PATENT DOCUMENTS

DE 102008035342 B4 6/2011

OTHER PUBLICATIONS

Daryal Kuntman, Airborne system to address leading cause of injuries in non-fatal airline accidents, ICAO Journal, vol. 55, No. 2, Mar. 2000. pp. 11-12, 27.
European Search Report from counterpart European application No. 12153959.7, dated May 14, 2012, 3 pp.
Examination Report from counterpart European application No. 12153959.7, dated May 31, 2012, 6 pp.
Response to Examination Report dated May 31, 2012, from counterpart European application No. 12153959.7, filed Sep. 20, 2012, 14 pp.
Third Party Observation from counterpart European application No. 12153959.7, dated Oct. 10, 2012, 10 pp.

* cited by examiner

*Primary Examiner* — Brent Swarthout
(74) *Attorney, Agent, or Firm* — Shumaker & Sieffert, P.A.

(57) ABSTRACT

Systems and methods for alerting a flight crew if a taxiing collision condition exists. An exemplary system on a host vehicle determines one or more first protection zones around other vehicles on the ground based on the received information about the other vehicles, determines a second protection zone around the host vehicle based on the stored information about the host vehicle and the sensor information and generates an alert, if any of the first protection zones occupies at least a portion of the same geographic area as the second protection zone. The received information includes position, ground speed, vehicle type information and heading or track information. The protection zones include a width dimension that is based on vehicle size information, a base length dimension that is based on the size information, and a variable component of the length dimension that is based on the ground speed.

14 Claims, 6 Drawing Sheets

AIRPORT TAXIWAY COLLISION ALERTING SYSTEM

BACKGROUND OF THE INVENTION

Ground operations at night, in low-visibility conditions, or at uncontrolled airports (i.e., those without an active traffic control facility) are particularly risky. Unlike during airborne operations, or during take-off and landing operations on a runway, aircraft normally taxi in close proximity to other aircraft and surface vehicles, so that the type of collision avoidance algorithms that are used for Traffic Collision Avoidance System (TCAS) or for runway collision alerting are not suited to surface operations because they would result in a high rate of unwanted alerts.

The advent of Autonomous Dependent Surveillance-Broadcast (ADS-B) systems, by which aircraft and surface vehicles transmit their own state data (identity, classification, position, velocity, track angle, etc.), and by which an aircraft may receive the state data from other aircraft and vehicles, enables the possibility of designing a system that can provide useful alerts against potential collisions. In particular, the availability of position data (latitude, longitude) derived from satellite-based Global Navigation Satellite Systems (GNSS) over the ADS-B data link allows for the prediction of the future position of an aircraft or vehicle to an accuracy which is significantly better than that available with standard TCAS systems.

SUMMARY OF THE INVENTION

The present invention provides systems and methods for alerting a flight crew if a taxiing collision condition exists. An exemplary system on a host vehicle includes a receiver that receives information about one or more other vehicles on the ground, memory that stores information about the host vehicle, one or more sensors that determines information about the host vehicle and an output device. The system also includes a processor that determines one or more first protection zones around each of the other vehicles based on the received information about the one or more other vehicles, determines a second protection zone around the host vehicle based on the stored information about the host vehicle and the sensor information and generates an alert, if any of the first protection zones occupies at least a portion of the same geographic area as the second protection zone. The generated alert is outputted via the output device.

In one aspect of the invention, the received information includes state and vehicle type information. The state information includes position, ground speed, and one of heading or track information. The one of the other vehicles and the host vehicle are aircraft and the type information includes size information.

In another aspect of the invention, the protection zones include a width dimension that is based on vehicle size information, a base length dimension that is based on the size information, and a variable component of the length dimension that is based on the ground speed.

BRIEF DESCRIPTION OF THE DRAWINGS

Preferred and alternative embodiments of the present invention are described in detail below with reference to the following drawings:

FIG. 3-1 is a conceptual drawing of the analysis performed by the system of FIG. 1 for a noncollision condition;

FIG. 3-2 is a plan view display of the noncollision condition based on the conceptual analysis as shown in FIG. 3-1;

FIG. 4-1 is a conceptual drawing of the analysis performed by the system of FIG. 1 for a collision condition;

FIG. 4-2 is a plan view display of the collision condition based on the conceptual analysis as shown in FIG. 4-1.

DETAILED DESCRIPTION OF THE INVENTION

Figure 1:
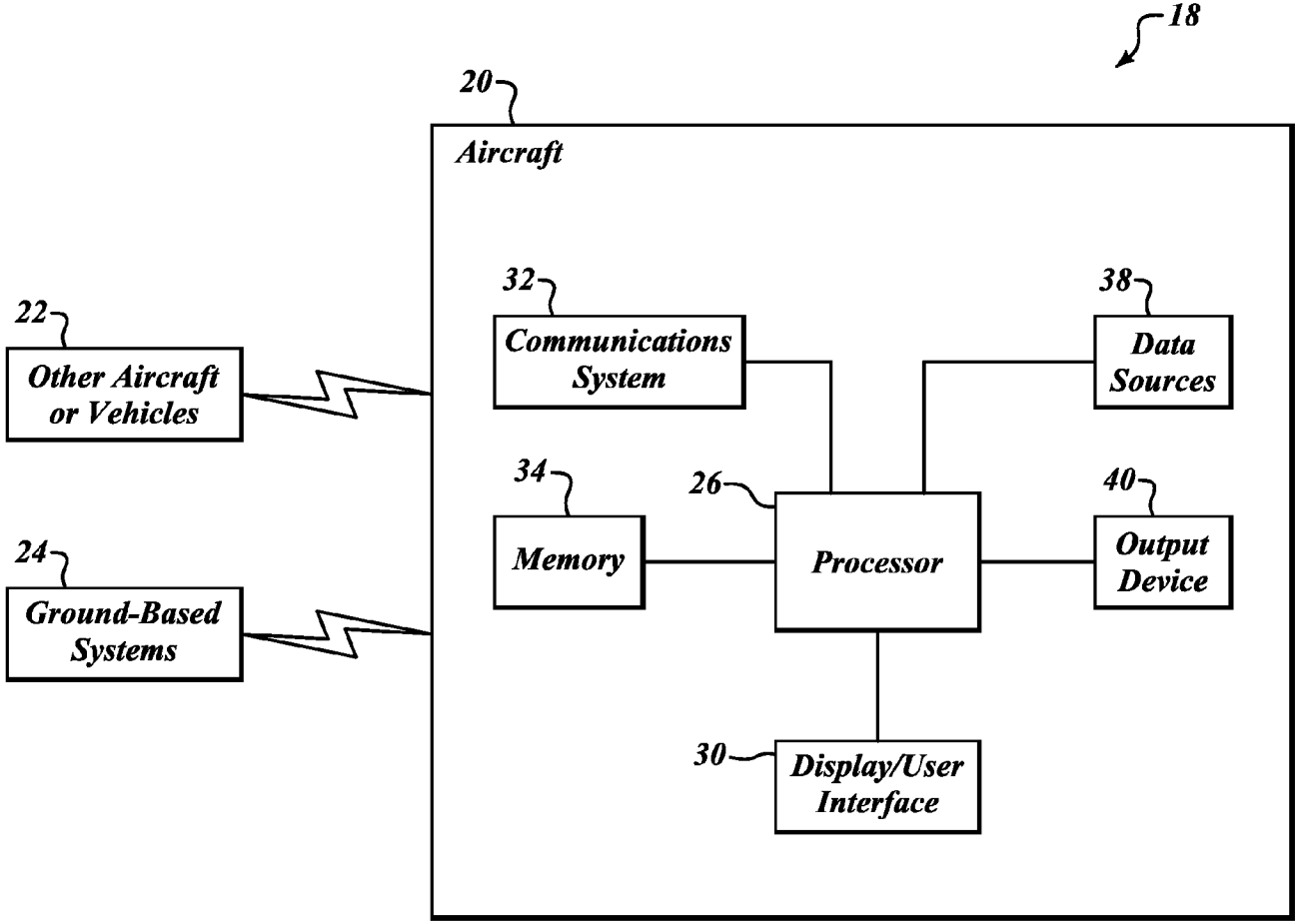
FIG. 1 is a block diagram of an exemplary system formed in accordance with an embodiment of the present invention.

FIG. 1 shows an exemplary vehicle collision alerting system 18 located on an aircraft or ground vehicle (own-ship 20) for providing warning and/or caution alerts if ground based trajectories of the own-ship 20 and any of the other vehicles 22 might lead to a collision. The system 18 includes a processor 26, one or more data sources 38 (e.g., global positioning system (GPS)), a display/user interface device 30, a communications system 32, memory 34, and one or more output devices 40.

The processor 26 sends and receives state information over a data channel via the communications system 32 (i.e., transponder). Using own-ship information (from the GPS or other system) and target (other) vehicle state (e.g., position, velocity, acceleration, track-angle and/or heading from the other vehicles 22 or a ground-based system 24) and vehicle type information, the processor 26 calculates two-dimensional buffer zones (boxes) that surround each of the own-ship 20 and the target vehicles 22. The processor 26 outputs an alert to the output device(s) 40 when the zones intersect.

A situational display of the traffic is provided on the display/user interface device 30 and the status of the traffic (i.e., the potential for a conflict) is depicted and/or an aural alert message is provided to the flight crew via the output device (e.g., headphones, speakers, tactile device) 40.

The present invention uses ADS-B state data received from the other aircraft or vehicles 22 and/or state data that is rebroadcast from a surface installation (the ground-based system 24), own-ship state data, type information, and one or more algorithms, to generate the zones and provide an alert against a potential collision on the surface of the airport that is not part of the runway environment (i.e., against potential collisions at relatively low speeds). For example, the rebroadcast state data includes Autonomous Dependent Surveillance-Report (ADS-R) data or data derived from surface radar and broadcast from a separate surface installation (i.e., Traffic Information Service Broadcast (TIS-B)). The one or more algorithms provide the flight crew with a display of potentially conflicting traffic in the case of a detected conflict. The alerting algorithms are designed such that the rate of unwanted alerts remains acceptably low.

The invention uses position, velocity, and track angle (or heading if speed is below a threshold value) data from the own-ship 20 and the other vehicles 22 to predict future relative positions of the own-ship 20 and the other vehicles 22. A map of airport taxiways is not necessary for performing this analysis.

Figure 2:
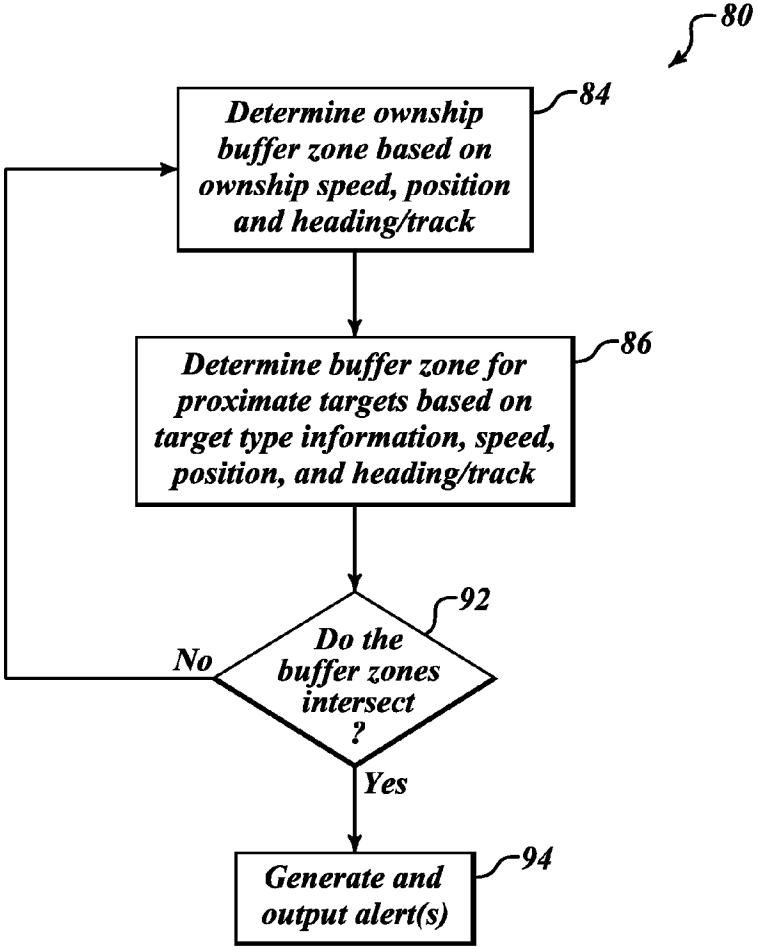
FIG. 2 is a flow diagram of an exemplary process performed by the system shown in FIG. 1.

FIG. 2 shows a flowchart of an exemplary process 80 performed by the processor 26. First, at blocks 84 and 86, a protective "box" area (i.e., buffer zone) is defined around the own-ship 20 and each of the other vehicles 22 within a threshold distance of the own-ship 20 based on the own-ship state and type data and the state and type data of the other vehicles 22, respectively. The size and orientation of the box vary proportional to the kinetic energy of the relative vehicle (i.e., the square of the speed: required stopping distance being a function of kinetic energy) and track angle of each. If the boxes of the own-ship 20 and any of the other vehicles 22 overlap, as determined at decision block 92, then a potential conflict exists and an alert is generated and outputted to the flight crew, see block 94.

In one embodiment, the processor 26 generates the buffer zone using physical size information of the own-ship and the traffic target. Size information (e.g., wing span and length) for the own-ship is derived by the system during installation, since the system "has knowledge" of the type of aircraft it is installed on. Size information for a traffic target is derived from the received ADS-B data by examining the "category" parameter transmitted by the target vehicle. This provides rough knowledge of size in the sense of "ground vehicle, small aircraft, medium aircraft, large aircraft".

In one embodiment, the ADS-B data for ground vehicles contains a "vehicle size" parameter, which is used to more accurately determine the dimensions of the protective box (buffer zone). Alternatively, more precise size information is derived by using the "Mode S" code number, which is transmitted by each aircraft on ADS-B. The Mode S code number is unique to the individual aircraft. The processor 26 determines the physical dimensions of the target aircraft by comparing the Mode S code number to a database of all registered aircraft according to Mode S code numbers to obtain aircraft type. The database is stored in the memory 34.

In one embodiment, the size of the box (buffer zone) has a fixed width dimension that is based on vehicle type information. The length dimension has a base minimum value that is based on vehicle type information. A forward dimension (L) of the length dimension varies according the vehicle's velocity. The following is example equation:

$$L=K1*\text{velocity}^2+K2*\text{velocity}+K3.$$

Figures 1, 3:
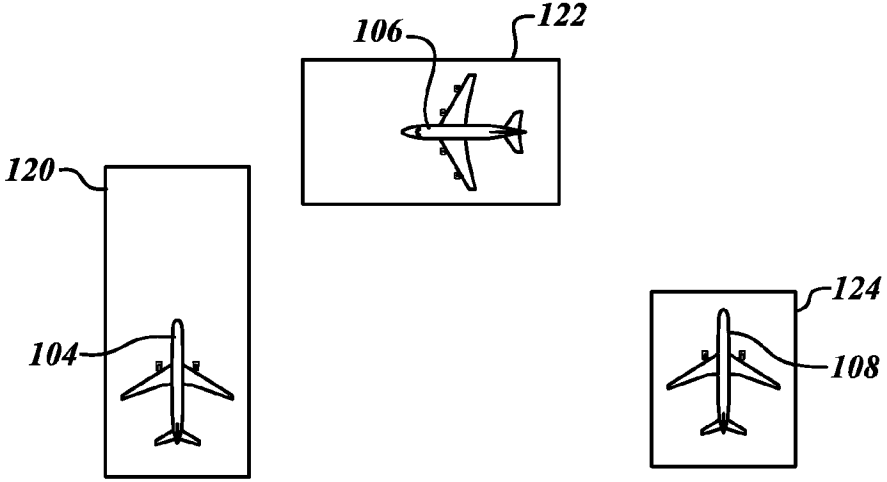
Figures 2, 3:
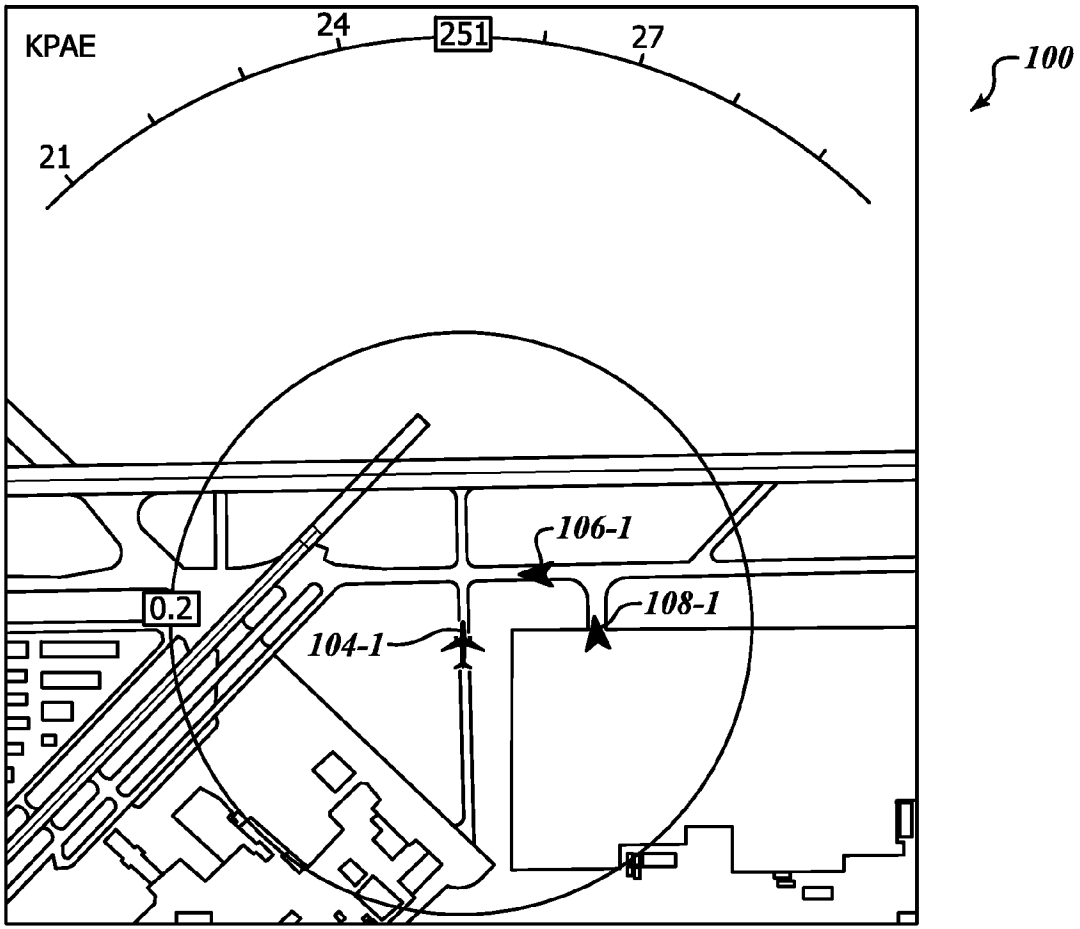

FIG. 3-1 illustrates boundary boxes 120, 122, 124 that are generated by the processor included within an own-ship aircraft 104 based on information of the own-ship aircraft 104 and the other proximate vehicles 106, 108. In this example, none of the boundary boxes 122, 124 overlaps with the boundary box 120 associated with the own-ship aircraft 104. Therefore, no alert is generated.

FIG. 3-2 illustrates a plan view 100 of an airport area showing the own-ship aircraft 104 identified by aircraft icon 104-1 on a taxiway B. Also depicted on the plan view 100 are other icons 106-1, 108-1 of the other vehicles 106, 108. The icon 106 associated with the vehicle (aircraft) 106 shows that the aircraft 106 is taxiing on taxiway A, which intersects taxiway B, currently occupied by the own-ship aircraft 104. The second vehicle (aircraft) 108, as indicated by the second icon 108-1, is just leaving a gate area of the airport.

Figures 1, 4:
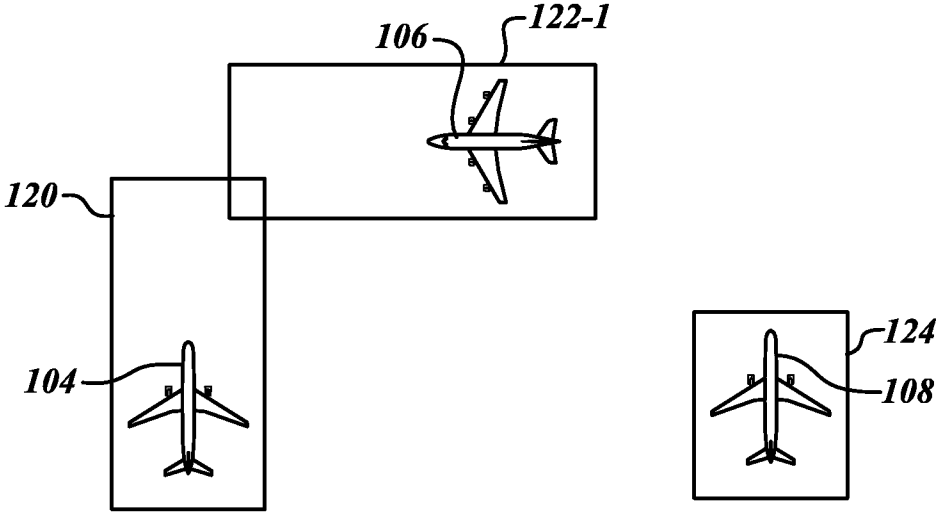
Figures 2, 4:
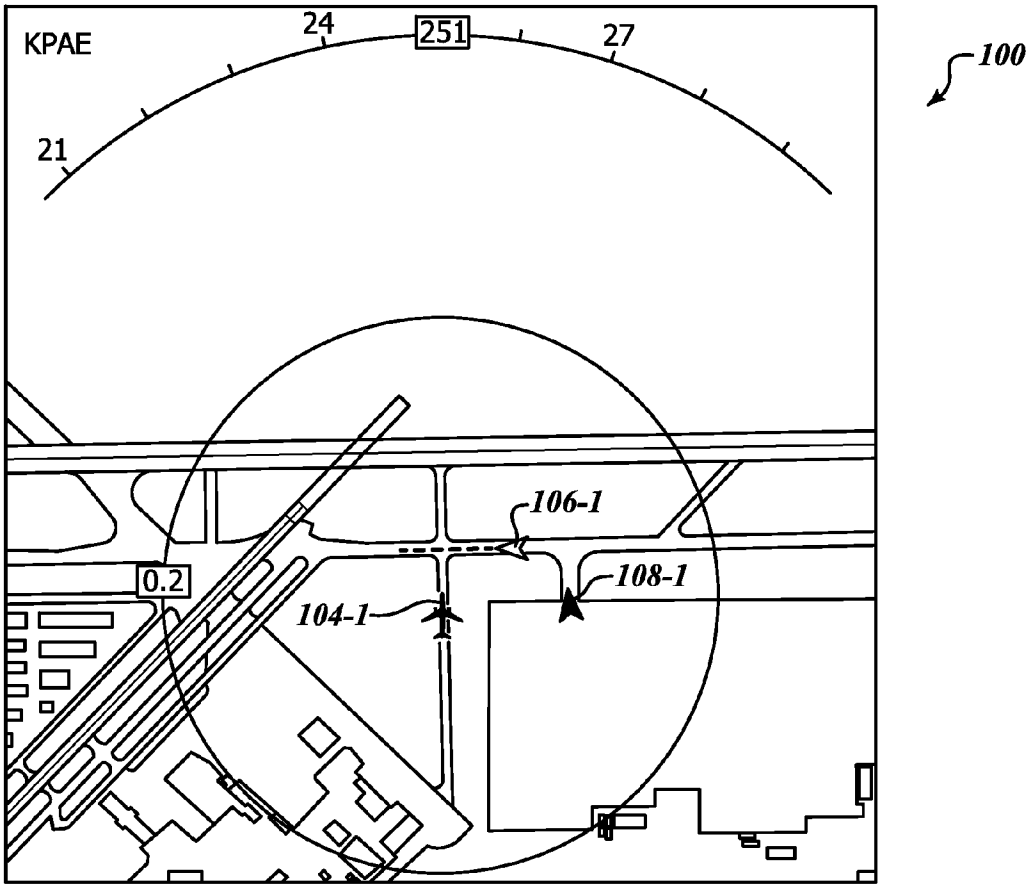

FIG. 4-1 illustrates a situation when the aircraft 106 has a greater velocity and thus a greater forward dimension of the determined boundary box 122-1 than the situation depicted in FIGS. 3-1, 3-2. Thus, an alert collision condition exists because the boundary box 122-1 overlaps with the boundary box 120 of the own-ship aircraft 104.

As shown in FIG. 4-2, the icon 106-1 is depicted uniquely from all the other displayed icons because the box 122-1 overlaps with the box 120 in order to communicate that a collision condition is possible. A line extending from the forward end of the icon 106-1 may be presented at the same time the icon 106-1 is uniquely depicted.

In one embodiment, different algorithms are used to define differently sized boundary boxes. Intersection of the differently sized boxes would trigger different types of alert conditions (e.g., caution, warning).

While the preferred embodiment of the invention has been illustrated and described, as noted above, many changes can be made without departing from the spirit and scope of the invention. For example, the function performed by the present invention is disabled in certain areas of the airport, such as the runways and the gate area in order to reduce nuisance warnings. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A method performed by a system on a host vehicle when the host vehicle is on the ground, the method comprising:

receiving information about one or more other vehicles operating on the ground;

receiving information about the host vehicle;

determining one or more protection zones around each of the other vehicles operating on the ground based on the received information about the one or more other vehicles operating on the ground;

determining a first protection zone around the host vehicle based on the received host vehicle information;

generating an alert, if any of the protection zones around each of the other vehicles occupies at least a portion of the same geographic area as the first protection zone around the host vehicle; and outputting the alert, wherein the received information about the one or more other vehicles and the host vehicle comprises state and vehicle type information, wherein the state information comprises position, ground speed, and directional information, wherein the directional information comprises at least one of heading or track information, wherein heading is used as directional information if speed is below a threshold value.

2. The method of claim 1, wherein the other vehicles operating on the ground comprise aircraft and ground vehicles and the type information comprises size information.

3. The method of claim 1, wherein the protection zones are geographic boxes.

4. The method of claim 3, wherein the geographic boxes comprise a width dimension that is based on the size information, a base length dimension that is based on the size information and a variable component of the length dimension that is based on the ground speed.

5. The method of claim 1, wherein receiving information about one or more other vehicles operating on the ground comprises receiving the information directly from the one or more other vehicles operating on the ground via a wireless data communication system.

6. The method of claim 1, wherein receiving information about one or more other vehicles operating on the ground comprises receiving the information from a stationary ground-based system.

7. The method of claim 1, further comprising:

determining a second protection zone around the host vehicle based on the received host vehicle information, the second protection zone comprises at least one dimension that is less than a comparable dimension of the first protection zone;

generating a second alert, if any of the protection zones around each of the other vehicles occupies at least a portion of the same geographic area as the second protection zone; and outputting the alert.

8. A system on a host vehicle comprising:

a receiver configured to receive information about one or more other vehicles on the ground;

memory configured to store information about the host vehicle;

one or more sensors configured to determine information about the host vehicle;

an output device; and a processor in signal communication with the receiver, the memory, the one or more sensors and the output device, the processor comprising:

a first component configured to determine one or more protection zones around each of the other vehicles based on the received information about the one or more other vehicles;

a second component configured to determine a first protection zone around the host vehicle based on the stored information about the host vehicle and the sensor information;

a third component configured to generate an alert, if any of the protection zones around each of the other vehicles occupies at least a portion of the same geographic area as the first protection zone; and a fourth component configured to output the alert via the output device, wherein the received information about the one or more other vehicles comprises state and vehicle type information, wherein the state information comprises position, ground speed, and directional information, wherein the directional information comprises at least one of heading or track information, wherein heading is used as directional information if speed is below a threshold value.

9. The system of claim 8, wherein one of the other vehicles operating on the ground comprise aircraft and ground vehicles and the type information comprises size information.

10. The system of claim 8, wherein the protection zones are geographic boxes.

11. The system of claim 10, wherein the geographic boxes comprise a width dimension that is based on the size information, a base length dimension that is based on the size information, and a variable component of the length dimension that is based on the ground speed.

12. The system of claim 8, wherein the receiver further comprises a wireless data communication system configured to receive the information directly from the one or more other vehicles.

13. The system of claim 12, wherein the wireless data communication system is further configured to receive the information from a stationary ground-based system.

14. The system of claim 8, wherein the processor further comprises:

a fifth component configured to determine a second protection zone around the host vehicle based on the received host vehicle information, the second protection zone comprises at least one dimension that is less than a comparable dimension of the first protection zone, wherein the third component generates a second alert, if any of the protection zones around each of the other vehicles occupies at least a portion of the same geographic area as the second protection zone, and wherein the fourth component outputting the alert.

* * * * *